US010251489B1

(12) United States Patent
Stone

(10) Patent No.: US 10,251,489 B1
(45) Date of Patent: Apr. 9, 2019

(54) BED ASSEMBLY AND RELATED METHODS

(71) Applicant: Anthony Stone, Bradenton, FL (US)

(72) Inventor: Anthony Stone, Bradenton, FL (US)

( * ) Notice: Subject to any disclaimer, the term of this patent is extended or adjusted under 35 U.S.C. 154(b) by 0 days.

(21) Appl. No.: 15/785,799

(22) Filed: Oct. 17, 2017

(51) Int. Cl.

| | |
|---|---|
| ***A47C 19/02*** | (2006.01) |
| ***A47C 21/04*** | (2006.01) |
| ***A47C 20/04*** | (2006.01) |
| ***A47B 23/02*** | (2006.01) |
| ***A63B 21/16*** | (2006.01) |
| ***A47C 21/00*** | (2006.01) |
| ***A63B 21/22*** | (2006.01) |
| ***A63B 21/055*** | (2006.01) |
| *A47C 17/86* | (2006.01) |

(52) U.S. Cl.
CPC ..... *A47C 19/021* (2013.01); *A47B 23/025* (2013.01); *A47C 19/022* (2013.01); *A47C 20/04* (2013.01); *A47C 21/003* (2013.01); *A47C 21/044* (2013.01); *A63B 21/0552* (2013.01); *A63B 21/1672* (2015.10); *A63B 21/22* (2013.01); *A47C 17/86* (2013.01)

(58) Field of Classification Search
CPC ..... A47C 17/86; A47C 19/021; A47C 19/022; A47C 19/22; A47C 20/04; A47C 21/003; A47C 21/044; A47B 23/025; A63B 21/1672
See application file for complete search history.

(56) References Cited

U.S. PATENT DOCUMENTS

| | | | | |
|---|---|---|---|---|
| 535,945 | A | 3/1895 | Donald | |
| 725,593 | A | 4/1903 | Schleuning | |
| 790,588 | A | 5/1905 | McLennan | |
| 1,297,144 | A * | 3/1919 | Giordano | A47C 19/22 5/131 |
| 1,347,271 | A | 7/1920 | Hartman | |
| 1,582,487 | A | 4/1924 | Shank | |
| 1,679,635 | A | 8/1928 | Steinberg et al. | |
| 1,719,614 | A | 7/1929 | McIntosh | |
| 2,305,548 | A | 12/1942 | Nichols | |
| 2,483,920 | A | 10/1949 | McLean et al. | |
| 2,501,309 | A * | 3/1950 | Braver | A47B 83/00 312/237 |
| 2,703,265 | A | 3/1955 | Wolfe | |
| 2,749,196 | A * | 6/1956 | Wolfe | A47B 23/025 108/8 |
| 2,904,798 | A | 9/1959 | Heflin | |
| 3,042,937 | A | 7/1962 | Young | |
| 3,455,295 | A | 7/1969 | Kellogg | |
| 3,540,435 | A | 11/1970 | Smith | |
| 3,826,490 | A | 7/1974 | Mossman | |
| 4,169,591 | A | 10/1979 | Douglas | |
| D256,526 | S | 8/1980 | Johnson | |

(Continued)

*Primary Examiner* — Nicholas F Polito
(74) *Attorney, Agent, or Firm* — Allen Dyer Doppelt & Gilchrist

(57) ABSTRACT

A bed assembly includes a bed frame having a head end and an opposed foot end. A first bed brace and a second bed brace are located at the head end and foot end of the bed frame. At least one upper sliding bar is configured to connect the upper ends of the first and second bed braces. The at least one upper sliding rail is configured to support an exercise apparatus. At least one work table is configured to slide back and forth along a lower sliding rail under the bed frame and concealed at the foot end of the bed frame when not in use.

20 Claims, 10 Drawing Sheets

(56) References Cited

U.S. PATENT DOCUMENTS 4,780,919 A * 11/1988 Harrison ..... A61G 7/02 5/308
4,887,325 A * 12/1989 Tesch ..... A61G 7/1015 5/84.1
4,903,353 A * 2/1990 Park ..... A47C 21/003 5/2.1
5,401,236 A * 3/1995 Summerville ..... A61H 1/0222 5/658
5,743,050 A * 4/1998 Shibata ..... A63B 71/0036 52/27
5,836,026 A * 11/1998 Reed ..... A61G 7/0533 5/662
6,163,906 A * 12/2000 Kay ..... A61G 7/053 5/658
6,216,293 B1 * 4/2001 Ruschke ..... A61G 7/0533 5/600
6,581,897 B2 6/2003 Ruschke
6,725,484 B2 4/2004 Drenik
6,984,057 B1 * 1/2006 Rogers ..... A47B 81/06 362/125
7,082,882 B2 8/2006 Heimbrock
7,181,784 B1 * 2/2007 Geilear ..... A47C 19/022 5/2.1
7,322,056 B2 1/2008 Cloward
7,340,789 B2 3/2008 Cloward
7,418,747 B1 * 9/2008 Myers ..... A47C 19/022 312/283
7,878,959 B2 2/2011 Chen et al.
8,430,910 B2 * 4/2013 Yen ..... A61G 7/015 602/32
9,393,455 B2 7/2016 Salamon et al.
2003/0126682 A1 * 7/2003 Drenik ..... A47C 19/22 5/200.1
2005/0034637 A1 * 2/2005 Heimbrock ..... A47B 23/025 108/49
2006/0075550 A1 * 4/2006 Hanson ..... A47B 21/0073 5/53.1
2008/0165481 A1 * 7/2008 Kirschner ..... A47B 81/064 361/679.07
2010/0107932 A1 5/2010 O'Neill
2017/0202357 A1 * 7/2017 Holzner ..... A47C 21/003

* cited by examiner

BED ASSEMBLY AND RELATED METHODS

FIELD OF THE INVENTION

The present invention relates to a bed assembly and more particularly to a multi-purpose bed system incorporating many functions.

BACKGROUND OF THE INVENTION

Most conventional beds are narrowly designed for human sleeping. Conventional beds usually have a fixed bed frame which cannot freely move upward or downward or be inclined. Most conventional beds do not integrate an adjustable exercise system, an entertainment system, or other functions considered useful nowadays. Some beds have been developed for incorporating functions other than sleeping, but their deficiencies and limitations suggest that further improvements can be realized.

SUMMARY OF THE INVENTION

In view of the foregoing, it is an object of the present invention to provide an improved bed assembly and related methods. According to one embodiment of the invention, a bed assembly includes a bed frame having a head end and an opposed foot end. A first bed brace and a second bed brace are located at the head end and at the foot end of the bed frame. At least one upper sliding bar is configured to connect the respective upper ends of the first and second bed braces. The at least one upper sliding rail is configured to support an exercise apparatus. At least one work table is configured to slide back and forth along a lower sliding rail under the bed frame and concealed at the foot end of the bed frame when not in use.

According to another embodiment of the invention, a bed assembly includes a bed frame having a head end and an opposed foot end. A first bed brace and a second bed brace are located at the head end and at the foot end of the bed frame. At least one upper sliding bar is configured to connect the respective upper ends of the first and second bed braces. The at least one upper sliding rail is configured to support an exercise apparatus. At least one work table is configured to slide back and forth along a lower sliding rail under the bed frame and concealed at the foot end of the bed frame when not in use. A monitor can be installed inside the foot end of the bed frame and configured to be elevated to a desired height.

These and other objects, aspects and advantages of the present invention will be better appreciated in view of the drawings and following detailed description of preferred embodiments.

DETAILED DESCRIPTION OF A PREFERRED EMBODIMENT

Figure 1:
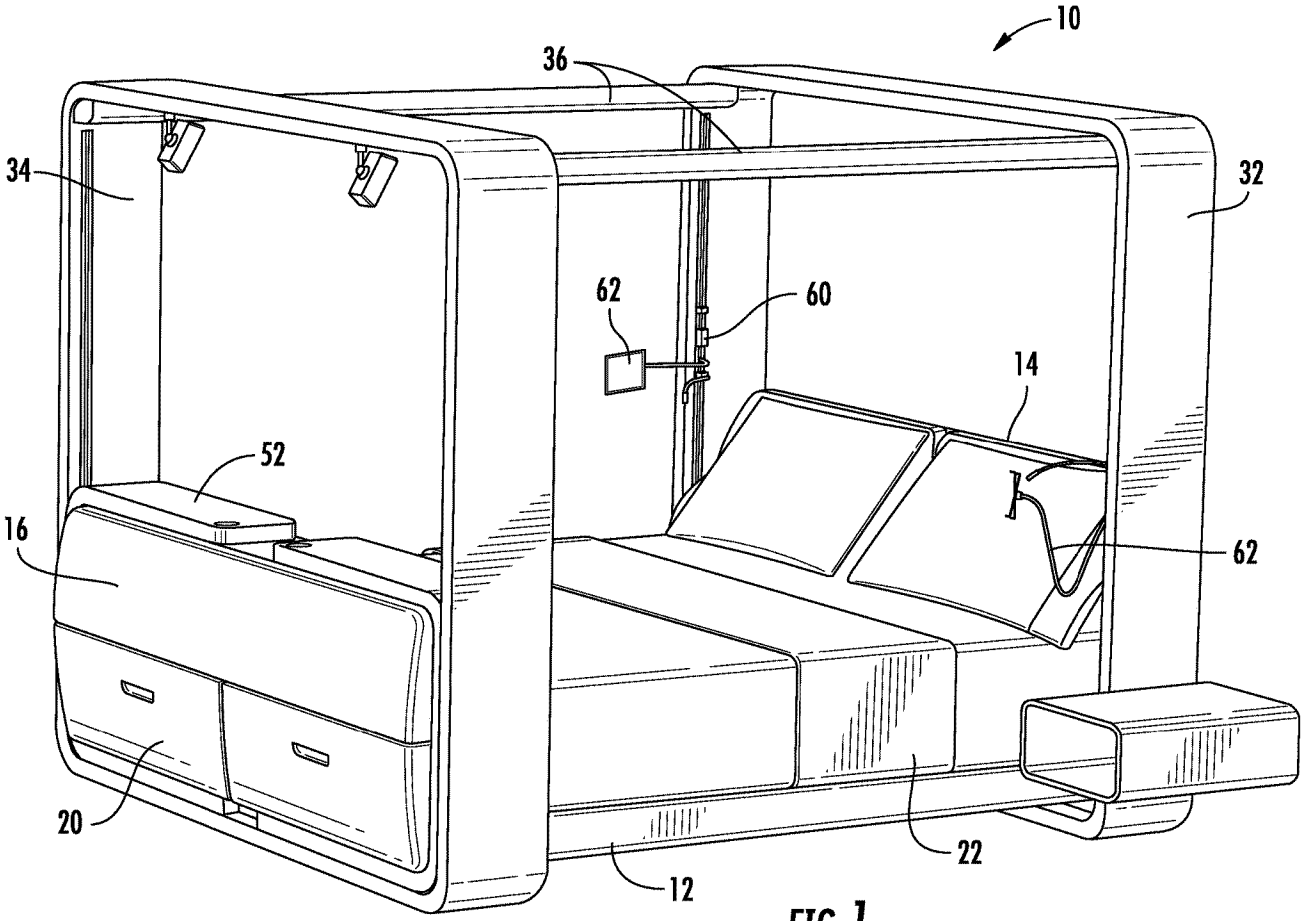
FIG. 1 is a perspective view of a bed assembly, according to an embodiment of the present invention.

According to an embodiment of the present invention, and referring to FIGS. 1-8, the bed assembly 10 includes a bed frame 12 having a head end 14 and an opposed foot end 16. The head end 14 includes a head board 18 configured to tilt forward, allowing a user to sit up straight or recline. The tilt angle can be adjusted as desired. The bed frame 12 is generally rectangular in shape and can be made of a plurality of supporting braces. At least one of the head end 14 and the foot end 16 can have storage drawers 20. The dimension and height of the bed frame 12 can be adjusted as desired. A mattress 22 is disposed on the bed frame 12.

Figure 2:
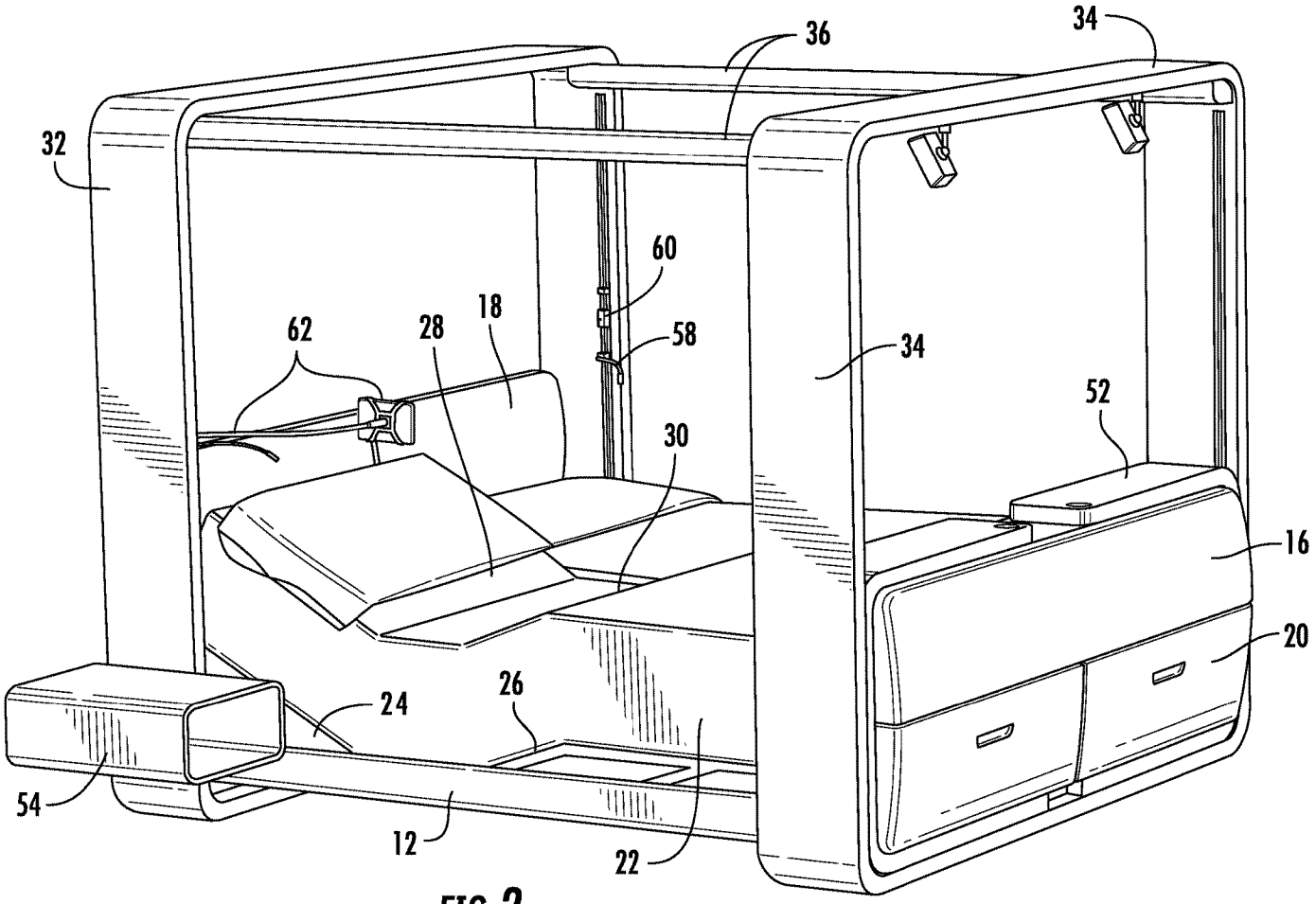
FIG. 2 is another perspective view of a bed assembly, according to another embodiment of the present invention.

Referring to FIG. 2, a portion of the bed frame 12 can be raised upwards to form one or more inclined planes. For example, a head portion 24 of the bed frame can be raised upward. A central portion 26 of the bed frame can also be raised upward to form a cradle-like area. The mattress 22 positioned on the top of the bed frame 12 can deform according to the angle of the respective inclined planes, forming the respective inclinable resting surfaces 28 and 30. The user's back can be positioned against the resting surface 28 at the head portion 24 while the legs are comfortably and securely positioned on the resting surface 30 at a the central portion 26—like being cradled by the bed assembly 10. The inclination angles of resting surfaces 28 and 30 can be adjusted independently.

A first bed brace 32 and a second bed brace 34 are located at the head end 14 and foot end 16. In the depicted embodiment, the first and second bed braces 32 and 34 are rectangular in shape with round corners. Other suitable designs are possible. The dimensions (e.g., width, height) of the first and second bed braces 32 and 34 can be adjusted as desired. The first and second bed braces 32 and 34 can have a modular design for easy assembly and disassembly. The first and second bed braces 32 and 34 are preferably made of wood for aesthetic value. However, other suitable materials can be used for the purpose.

At least one upper sliding rail 36 is configured to connect the respective upper ends of the first and second bed braces 32 and 34. In the depicted embodiment, two upper sliding rails 36 are connected to the two upper corners of the first and second bed braces 32 and 34. The at least one sliding rail 36 can be welded to the respective connection points on the first bed brace 32 and to the second bed brace 34. Alternatively, or in addition, the at least one sliding rail 36 can be releasably attached to the first and second bed braces 32 and 34 using screws or other fasteners. The length of the at least one upper sliding rail 36 can be adjusted to fit different bed frame sizes. The at least one upper sliding rail 36 is preferably made of light-weighted and sturdy material such as aluminum, steel, and the like to facilitate transport and handling of bed assembly 10.

Figure 3:
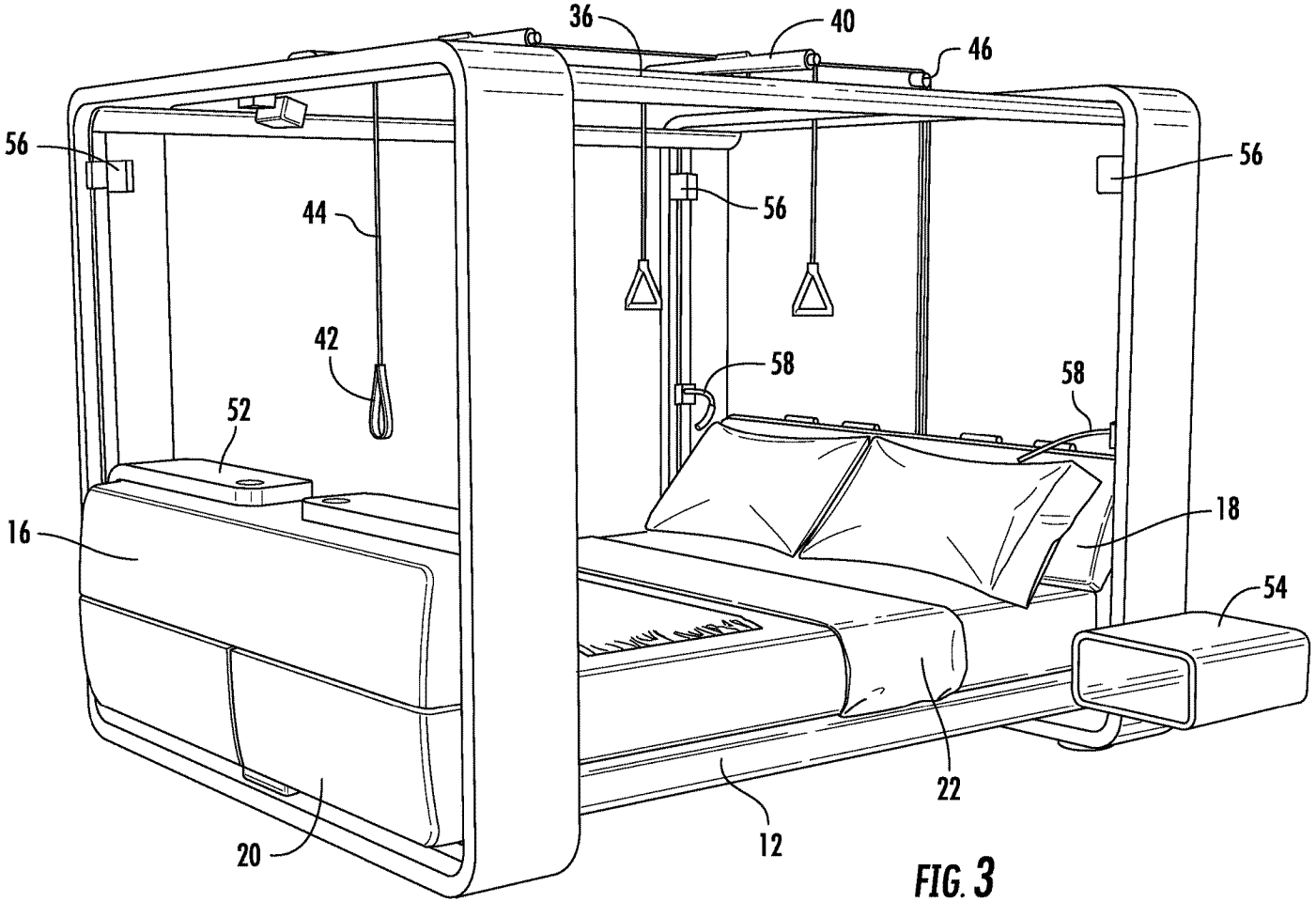
FIG. 3 is another perspective view of a bed assembly, according to another embodiment of the present invention.
Figure 4:
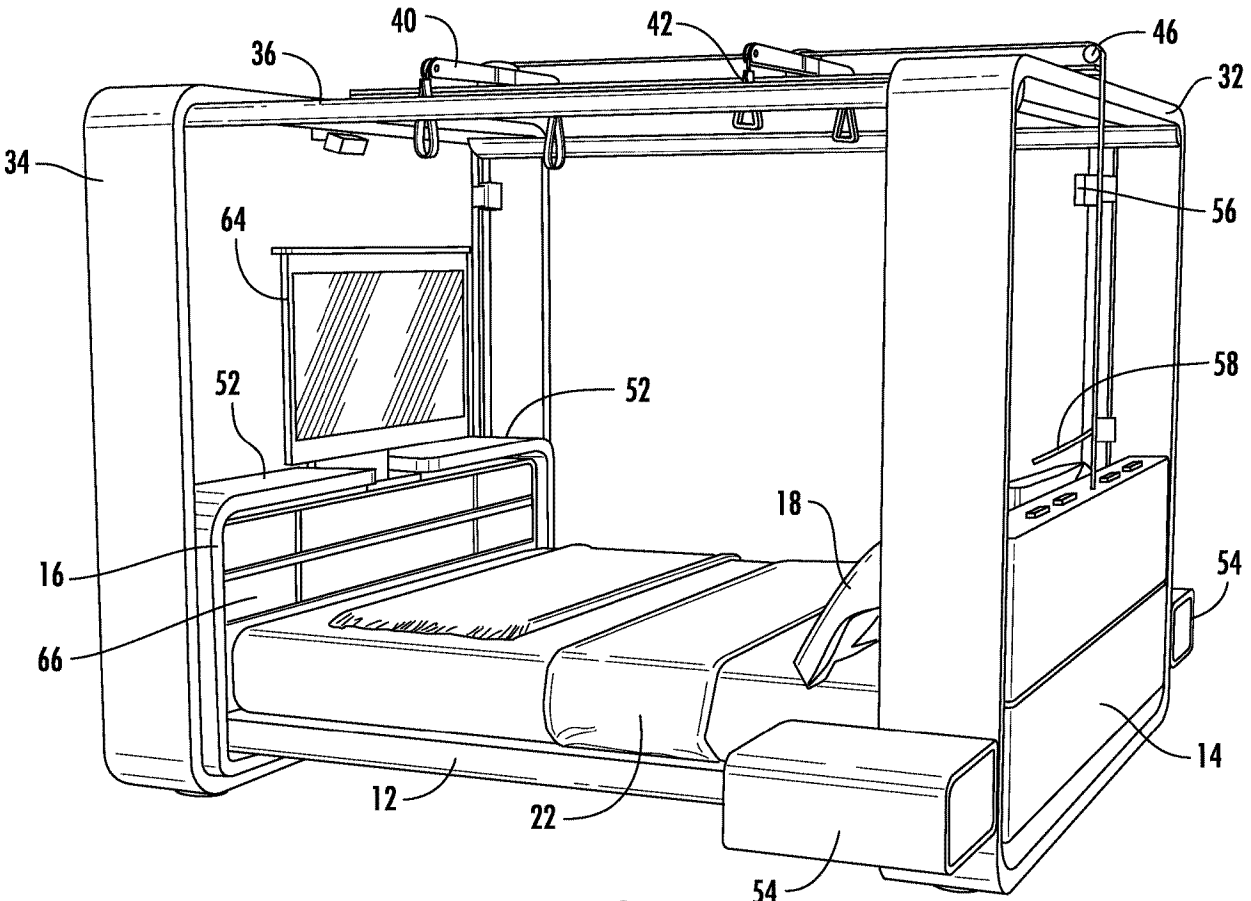
FIG. 4 is another perspective view of a bed assembly, according to another embodiment of the present invention.

The at least one upper sliding rail 36 is configured to support an exercise apparatus 38. Referring to FIG. 3, the exercise apparatus 38 includes at least one horizontal support member 40 having one or more workout grips 42 suspended therefrom. Resistance of elastomeric bands 44 connected to the respective workout grips 42 can be individually adjusted from a computer interface. For example, the elastomeric band 44 can be wrapped around a rotatable spool thereby forming a pulley. A user can adjust the tension of the pulley, thereby adjusting the resistive force of the band 44. The one or more bands 44 are retractable when not in use, as shown in FIG. 4. In the depicted embodiment, the two horizontal support members 40 are positioned on the at least one upper sliding rail for upper body exercise or lower body exercise. The two horizontal support members 40 can move horizontally along the at least one upper sliding rail 36 via a pulley system 46.

Figure 5:
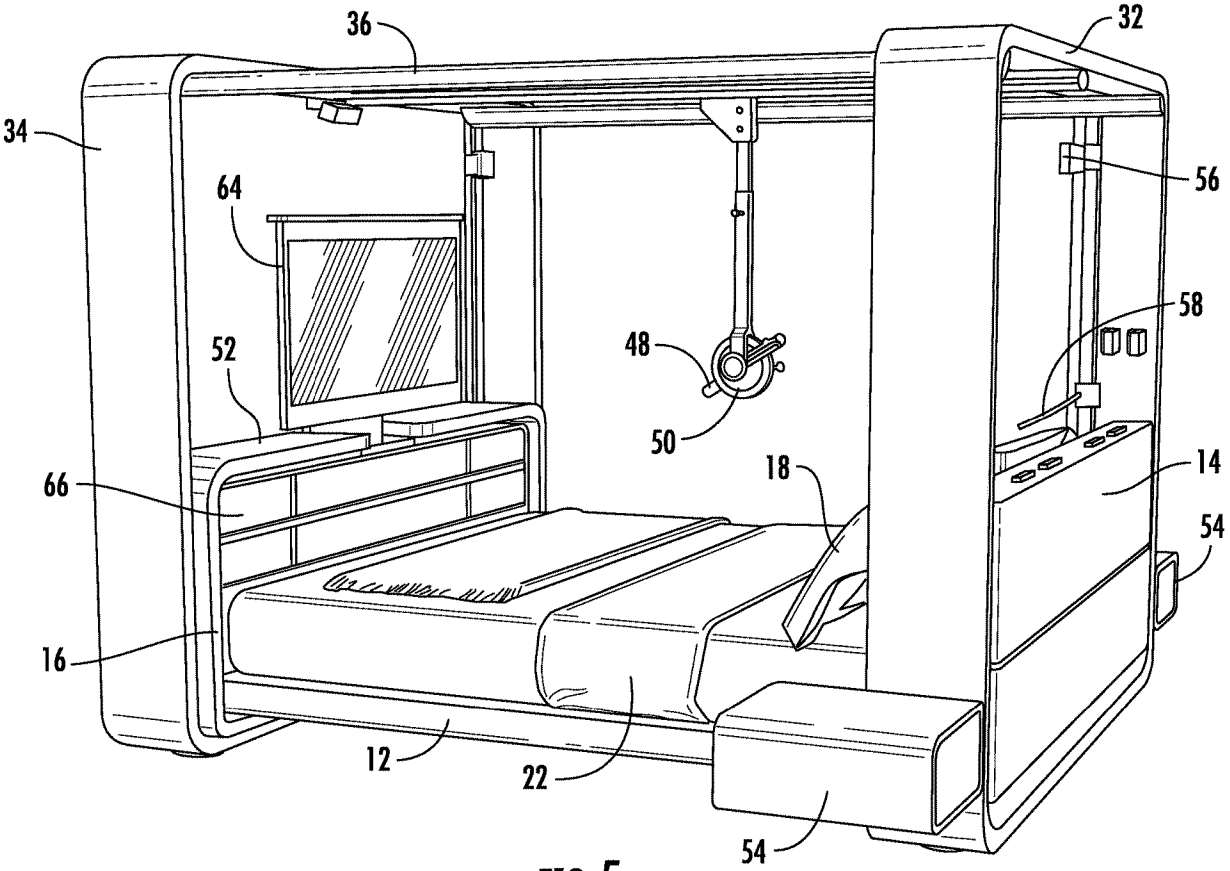
FIG. 5 is another perspective view of a bed assembly, according to another embodiment of the present invention.

Referring to FIG. 5, according to another embodiment of the present invention, the exercise apparatus 38 includes a crank 48 suspended from the at least one upper sliding rail 36 with a dial 50 for adjusting resistance. The bed assembly 10 can support a user in supine position, so that the user can reach upwardly with the arms and legs to grasp or contact a crank 48. The crank 48 will be a hand crank of foot depending on its location. The crank 48 can move horizontally and vertically for adjustment of reach distance, enabling persons of different stature to make advantageous use of the exercise apparatus under different degrees of stretching of the arms or the legs. The user can set the resistance of the dial 46 by a computer interface. The exercise apparatus 38 can thus be used as an upper body apparatus by moving the crank 48 toward the head end and upward or as a lower body apparatus by moving the crank 48 toward the foot end and downward.

Figure 9:
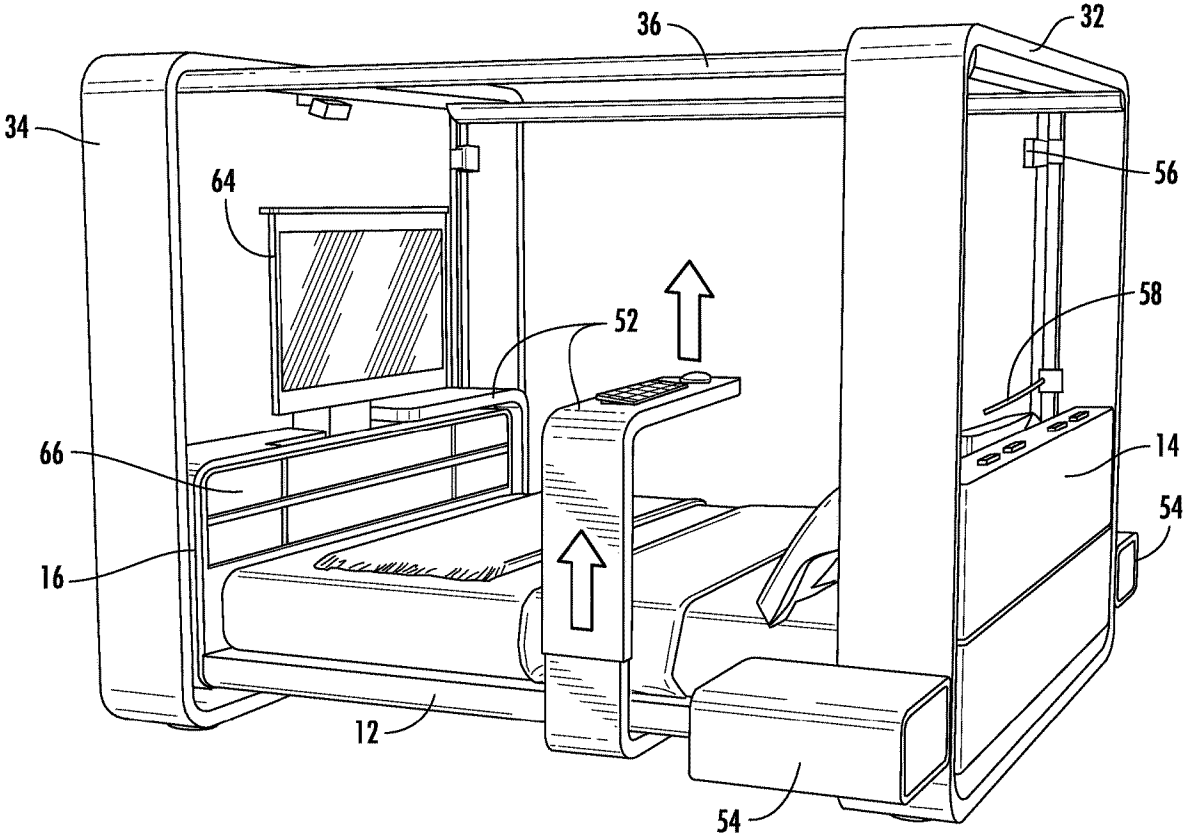
FIG. 9 is another perspective view of a bed assembly, according to another embodiment of the present invention.
Figure 10:
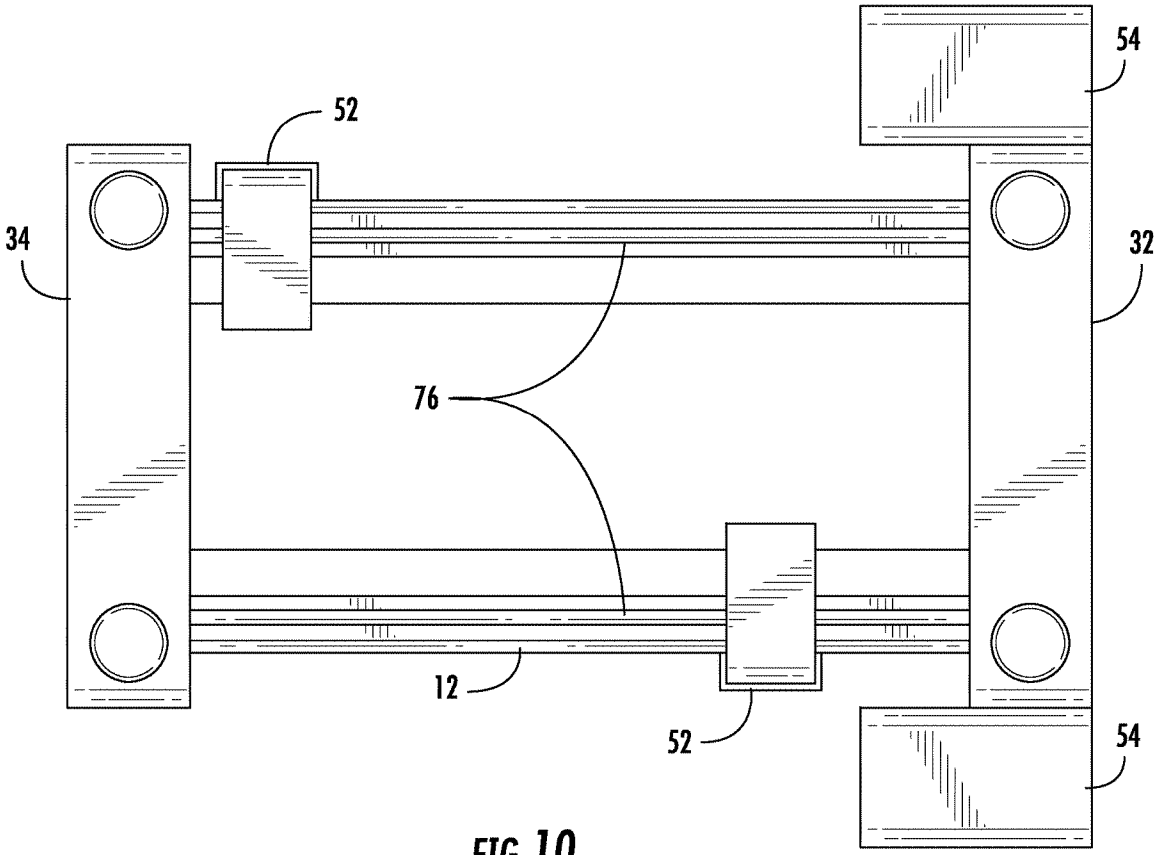
FIG. 10 is a bottom view of a bed assembly, according to another embodiment of the present invention.

FIG. 10 shows a bottom view of the bed assembly according to one embodiment of the present invention. The bed assembly 10 further includes at least one table 52 configured to slide back and forth on a lower sliding rail 76 (shown in FIG. 10) under the bed frame 12 and concealed at the foot end 16 of the bed assembly when not in use. The at least one table 52 can be easily moved into and out of position, and form a stable horizontal surface for the convenient use of a user in bed. The at least one table 52 can include a cup holder. FIG. 9 illustrates the height of the at least one table 52 can be adjustable. In the depicted embodiment, two work tables 52, one on each side of the bed frame 12, are shown.

Referring to FIGS. 1-8, the bed assembly 10 further includes a side compartment 54 for storing electronic devices, documents or other objects. The side compartment 54 can be configured with inductive charging capability for charging electronic devices. At least one speaker 56 and/or reading light 58 can be attached to at least one of the first and second bed braces 32 and 34. One or more charging outlets 60 can also be attached to the first and second bed braces 32 and 34, as shown in FIG. 1. The bed assembly 10 can also include a smart device holder 62.

Figure 6:
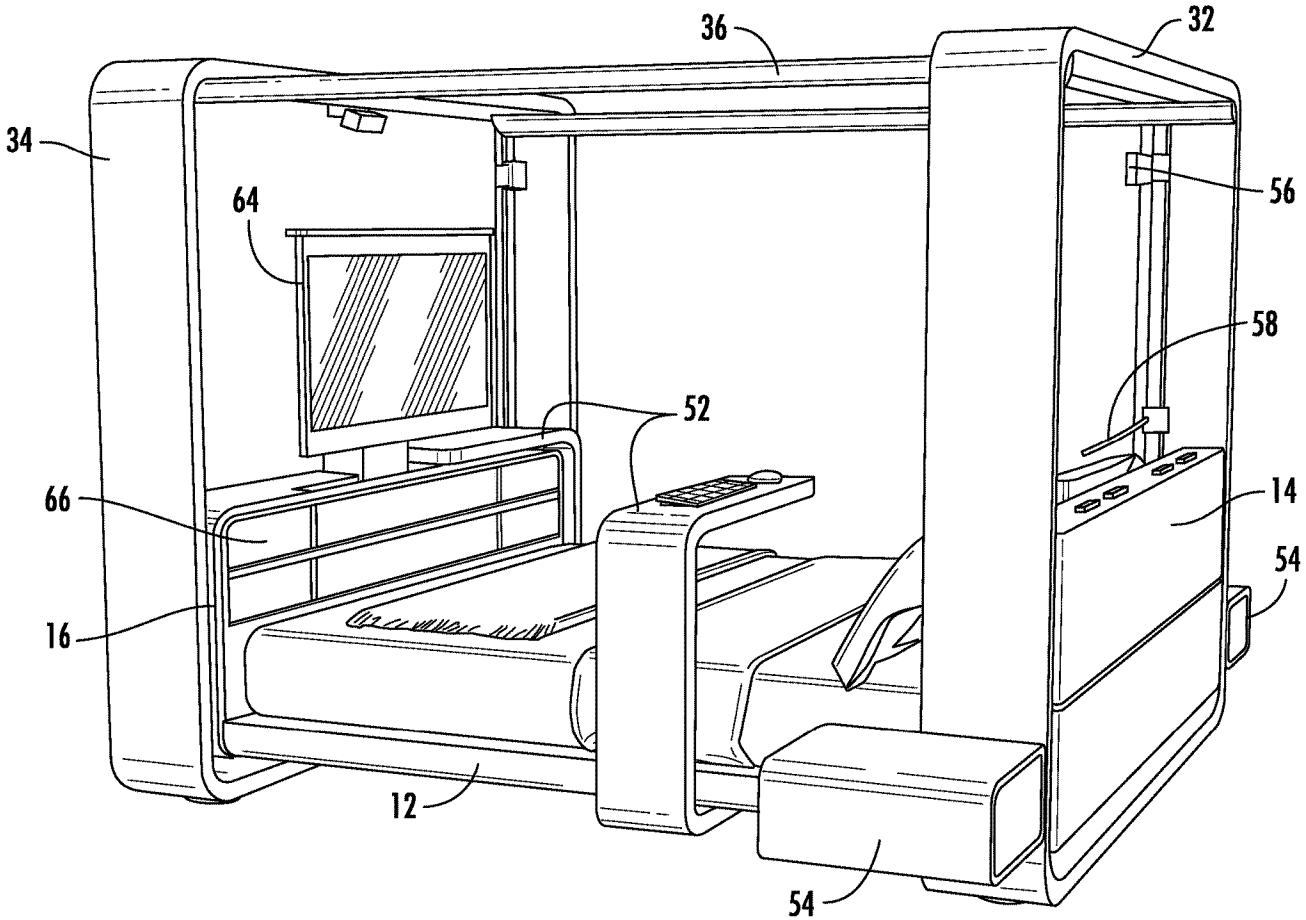
FIG. 6 is another perspective view of a bed assembly, according to another embodiment of the present invention.

Referring to FIG. 6, a monitor 64 can be installed inside the foot end 16 of the bed assembly 10 and elevated to a desired height. The foot end 16 of the bed assembly 10 can further include one or more compartments 66 for storing one or more cable boxes, gaming boxes, other electronic equipment, and the like.

Figure 7:
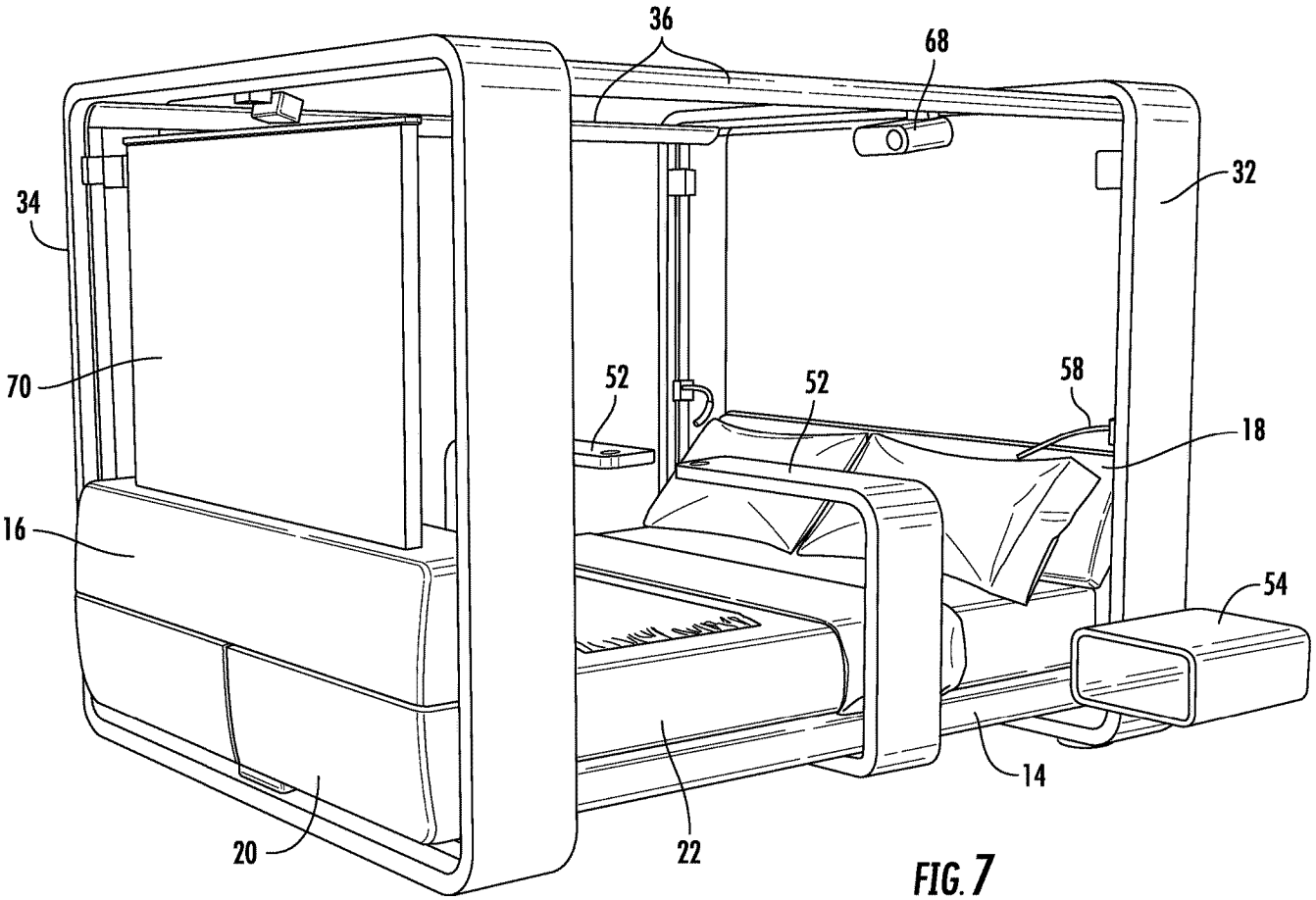
FIG. 7 is another perspective view of a bed assembly, according to another embodiment of the present invention.

Alternatively, referring to FIG. 7, according to another embodiment of the present invention, the bed assembly 10 can include a projector 68 mounted on the head end 14 of the bed frame 12 and a projector screen 70 mounted on the foot end 16 of the bed frame 12.

Figure 8:
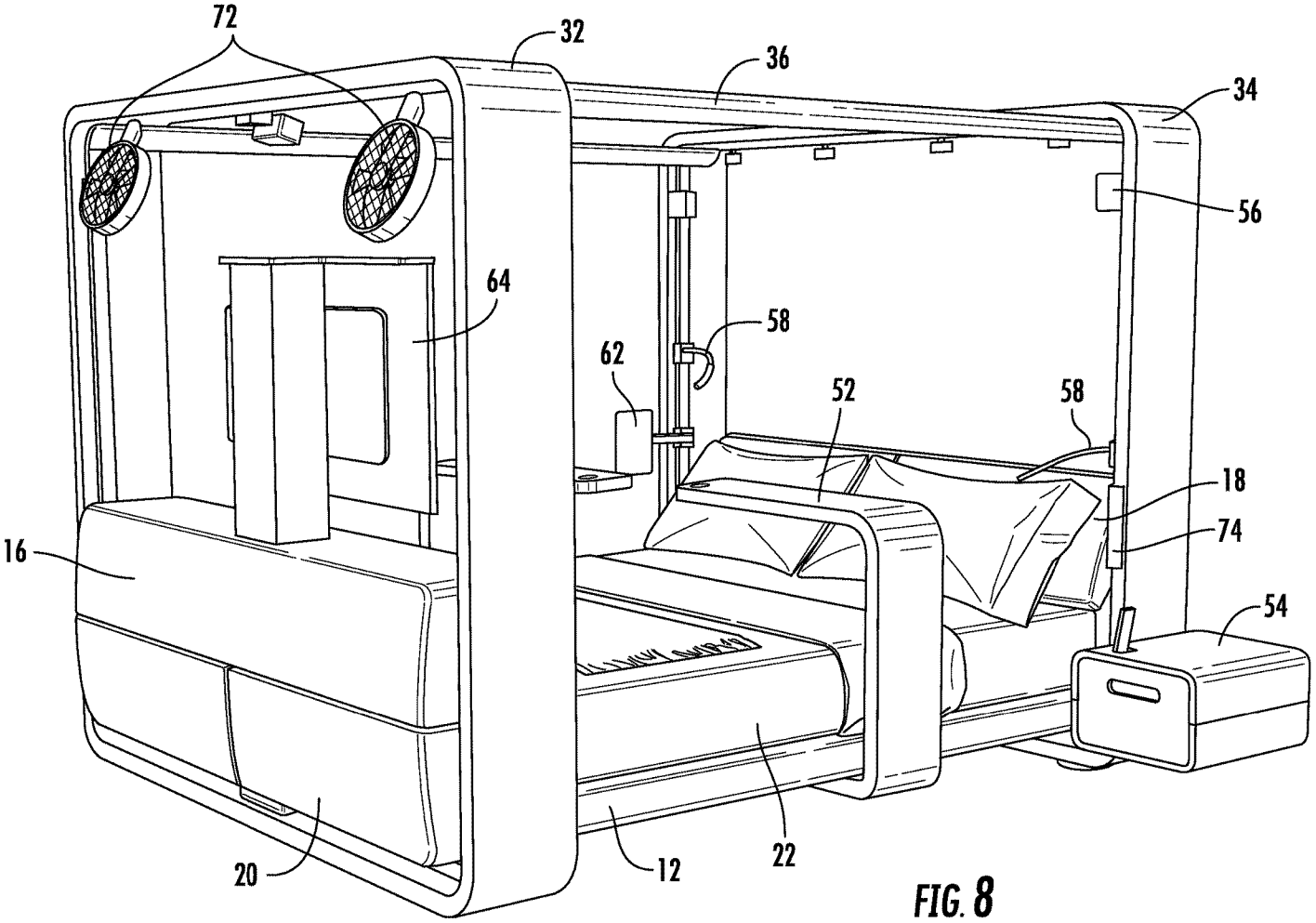
FIG. 8 is another perspective view of a bed assembly, according to another embodiment of the present invention.

Referring to FIG. 8, at least one fan 72 can be mounted on at least one of the first and the second bed braces 32 and 34. A remote control holder 74 is attached to the first bed brace 32. The bed assembly 10 can further include a refrigerated drawer (not shown), on one or both sides of the bed assembly 10 for storing refreshments.

The bed assembly 10 can be used for many purposes, for example, to provide comfort and relaxation for users who have stressful jobs or lifestyles or to provide efficient use of space. The bed assembly 10 can provide a highly effective and beneficial exercising apparatus for persons to perform exercise to increase blood circulation, stimulated muscle tone, and at the same time, provide visual and audio entertainment to the user. The bed assembly 10 can also be used for comfort in reading or enjoying refreshment and drinks. The bed assembly 10 thus can increase the efficiency of utilization of floor space.

In view of the foregoing, it will be appreciated that the bed assembly of the present invention can incorporate multiple functions, from exercising to entertainment. The present invention thus eliminates the need for a user to travel to distant locations to achieve a plurality of purposes (e.g., a gym to exercise, a different room to view TV, a different room to access computer). Moreover, the bed assembly 10 is readily adaptable to a wide range of bed sizes.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A bed assembly comprising:

a bed frame extending between a head end and a foot end opposite the head end along a length axis;

first and second bed braces located at the head end and foot end of the bed frame, respectively, the first and second bed braces defining a first and second openings, respectively, surrounding the length axis;

at least two parallel upper sliding rails extending in parallel with the length axis and connecting respective upper ends of the first and second bed braces; and at least one table configured to slide along on a lower sliding rail extending in parallel with the length axis under the bed frame, the at least one table being, in a perpendicular direction to the length axis, concealed behind the second bed brace within the second when not in use;

wherein the at least two parallel upper sliding rails are configured to support an exercise apparatus.

2. The bed assembly of claim 1, wherein the exercise apparatus includes at least one grip with respective elastomeric band attached thereto.

3. The bed assembly of claim 2, wherein resistance of the elastomeric band is adjustable.

4. The bed assembly of claim 2, wherein the elastomeric band is retractable when not in use.

5. The bed assembly of claim 1, wherein the exercise apparatus includes a crank with a dial for adjusting resistance of the crank.

6. The bed assembly of claim 5, wherein the position of the crank is configured to move horizontally and vertically for adjusting the reach distance to the crank.

7. The bed assembly of claim 5, wherein the resistance of the crank is configured to be adjustable via a computer interface.

8. The bed assembly of claim 1, wherein a head board at the head end is configured to tilt forward to allow to a user to be in a sit up position.

9. The bed assembly of claim 1, wherein at least one of the foot end and the head end has storage drawers.

10. The bed assembly of 1, wherein a height of the at least one table is adjustable.

11. The bed assembly of claim 1, further comprising a compartment attached to the bed frame having inductive charging capability.

12. The bed assembly of claim 1, wherein at least one speaker is attached to at least one of the first and second bed braces.

13. The bed assembly of claim 1, wherein a monitor is installed inside the foot end of the bed frame and is configured to be elevated to a desired height.

14. The bed assembly of claim 1, wherein the foot end of the bed frame includes one or more compartments for storing a cable box and a gaming box.

15. The bed assembly of claim 1, wherein at least one reading light is mounted on the first bed brace at the head end of the bed frame.

16. The bed assembly of claim 1, further comprising one or more fans mounted on at least one of the first bed brace and the second bed brace.

17. The bed assembly of claim 1, wherein a height of the bed frame is adjustable.

18. The bed assembly of claim 1, wherein a portion of the bed frame is configured to be raised upward to form one or more inclined planes.

19. The bed assembly of claim 1, further comprising a projector mounted on the head end of the bed frame and a projector screen mounted on the foot end of the bed frame.

20. A bed assembly comprising:

a bed frame extending between a head end and a foot end opposite the head end along a length axis;

first and second bed braces located at the head end and foot end of the bed frame, respectively, the first and second bed braces defining a first and second openings, respectively, surrounding the length axis;

at least two parallel upper sliding rails extending in parallel with the length axis and connecting respective upper ends of the first and second bed braces;

at least one table configured to slide along on a lower sliding rail extending in parallel with the length axis under the bed frame, the at least one table being, in a perpendicular direction to the length axis, concealed behind the second bed brace within the second opening when not in use; and a monitor installed inside the foot end of the bed frame within the second opening of the second bed brace and configured to be elevated to a desired height;

wherein the at least one upper sliding rail is configured to support an exercise apparatus.

* * * * *